US011153699B2

(12) United States Patent
Westergaard et al.

(10) Patent No.: US 11,153,699 B2
(45) Date of Patent: Oct. 19, 2021

(54) METHOD OF OPERATING A HEARING AID FITTING SYSTEM AND A HEARING AID FITTING SYSTEM

(71) Applicant: WIDEX A/S, Lynge (DK)

(72) Inventors: Anders Westergaard, Herlev (DK); Morten Surballe, Allerod (DK); Jacob Palitzsch Lund, Tikob (DK); Jacob Midtgaard, Fredensborg (DK)

(73) Assignee: WIDEX A/S, Lynge (DK)

( * ) Notice: Subject to any disclaimer, the term of this patent is extended or adjusted under 35 U.S.C. 154(b) by 0 days.

(21) Appl. No.: 16/696,244

(22) Filed: Nov. 26, 2019

(65) Prior Publication Data

US 2020/0100038 A1 Mar. 26, 2020

Related U.S. Application Data

(63) Continuation of application No. PCT/EP2018/064067, filed on May 29, 2018.

(51) Int. Cl.
*H04R 25/00* (2006.01)

(52) U.S. Cl.
CPC ..... *H04R 25/70* (2013.01); *H04R 25/30* (2013.01); *H04R 25/505* (2013.01); *H04R 25/558* (2013.01); *H04R 2225/43* (2013.01)

(58) Field of Classification Search
CPC ..... H04R 25/70; H04R 25/30; H04R 25/505; H04R 25/558; H04R 2225/43
USPC ..... 381/314
See application file for complete search history.

(56) References Cited

U.S. PATENT DOCUMENTS

| | | | | |
|---|---|---|---|---|
| 4,989,251 | A | 1/1991 | Mangold | |
| 6,782,110 | B1 | 8/2004 | Sigwanz et al. | |
| 8,064,609 | B2 | 11/2011 | Baechler et al. | |
| 2012/0140962 | A1 | 6/2012 | Ubezio et al. | |
| 2013/0202123 | A1* | 8/2013 | Nishizaki | H04R 25/70 381/60 |
| 2014/0126731 | A1* | 5/2014 | Litvak | H04R 25/305 381/60 |
| 2014/0348327 | A1* | 11/2014 | Linde | H04H 20/88 381/2 |
| 2015/0624314 | | 9/2015 | Goesnar et al. | |
| 2016/0044425 | A1 | 2/2016 | Westergaard et al. | |
| 2016/0173278 | A1 | 6/2016 | Pedersen et al. | |

FOREIGN PATENT DOCUMENTS

| | | | |
|---|---|---|---|
| EP | 2 317 780 | B1 | 12/2016 |
| EP | 3 113 515 | A1 | 1/2017 |
| WO | 90/09760 | A1 | 9/1990 |
| WO | 2007/020300 | A2 | 2/2007 |
| WO | 2013091693 | A1 | 6/2013 |

OTHER PUBLICATIONS

Danish Search Report for 2017 00326 dated Sep. 8, 2017.
International Search Report for PCT/EP2018/064067 dated Aug. 14, 2018 (PCT/ISA/210).
Written Opinion of the International Searching Authority for PCT/EP2018/064067 dated, Aug. 14, 2018 (PCT/ISA/237).

* cited by examiner

*Primary Examiner* — Sean H Nguyen
(74) *Attorney, Agent, or Firm* — Sughrue Mion, PLLC

(57) ABSTRACT

A method (200) of fitting a hearing aid system, and a hearing aid fitting system (100) as well as a hearing aid system adapted to carry out the method.

12 Claims, 3 Drawing Sheets

METHOD OF OPERATING A HEARING AID FITTING SYSTEM AND A HEARING AID FITTING SYSTEM

The present invention relates to a method of fitting a hearing aid system. The present invention also relates to a hearing aid fitting system and a hearing aid system.

BACKGROUND OF THE INVENTION

Generally a hearing aid system may be any system which provides an output signal that can be perceived as an acoustic signal by a user or contributes to providing such an output signal, and which has means which are used to compensate for an individual hearing loss of the user or contribute to compensating for the hearing loss of the user. These systems may comprise hearing aids which can be worn on the body or on the head, in particular on or in the ear, and can be fully or partially implanted. However, some devices whose main aim is not to compensate for a hearing loss, may also be regarded as hearing aid systems, for example consumer electronic devices (televisions, hi-fi systems, mobile phones, MP3 players etc.) provided they have, however, measures for compensating for an individual hearing loss.

Within the present context a hearing aid may be understood as a small microelectronic device designed to be worn behind or in the human ear by a hearing-impaired user. The hearing aid may be powered by a battery or some other energy source. Prior to use, the hearing aid is adjusted by a hearing aid fitter according to a prescription. The prescription is based on a hearing test, resulting in a so-called audiogram, of the performance of the hearing-impaired user's unaided hearing. The prescription is developed to reach a setting where the hearing aid will alleviate a hearing loss by amplifying sound at frequencies in those parts of the audible frequency range where the user suffers a hearing deficit. A hearing aid comprises one or more microphones, a battery, a microelectronic circuit comprising a signal processor, and an acoustic output transducer. The signal processor is preferably a digital signal processor. The hearing aid is enclosed in a casing suitable for fitting behind or in a human ear. For this type of traditional hearing aids the mechanical design has developed into a number of general categories. As the name suggests, Behind-The-Ear (BTE) hearing aids are worn behind the ear. To be more precise, an electronics unit comprising a housing containing the major electronics parts thereof is worn behind the ear, and an earpiece for emitting sound to the hearing aid user is worn in the ear, e.g. in the concha or the ear canal. In a traditional BTE hearing aid, a sound tube is used to convey sound from the output transducer, which in hearing aid terminology is normally referred to as the receiver, located in the housing of the electronics unit and to the ear canal. In some modern types of hearing aids a conducting member comprising electrical conductors conveys an electric signal from the housing and to a receiver placed in the earpiece in the ear. Such hearing aids are commonly referred to as Receiver-In-The-Ear (RITE) hearing aids. In a specific type of RITE hearing aids the receiver is placed inside the ear canal. This category is sometimes referred to as Receiver-In-Canal (RIC) hearing aids. It has been suggested to design RITE or RIC hearing aids, wherein only the ear parts comprise at least one microphone. Another category of hearing aids is characterized in that at least one microphone is arranged in each of a behind the ear part and an earpiece part. In-The-Ear (ITE) hearing aids are designed for arrangement in the ear, normally in the funnel-shaped outer part of the ear canal. In a specific type of ITE hearing aids the hearing aid is placed substantially inside the ear canal. This category is sometimes referred to as Completely-In-Canal (CIC) hearing aids. This type of hearing aid requires an especially compact design in order to allow it to be arranged in the ear canal, while accommodating the components necessary for operation of the hearing aid.

Generally a hearing aid system may comprise a single hearing aid (a so called monaural hearing aid system) or comprise two hearing aids, one for each ear of the hearing aid user (a so called binaural hearing aid system). Furthermore the hearing aid system may comprise an external device, such as a smart phone having software applications adapted to interact with the other devices of the hearing aid system.

In a traditional hearing aid fitting, the hearing aid user travels to an office of a hearing aid fitter, and the user's hearing aids are adjusted using the fitting equipment that the hearing aid fitter has in his office. Typically the fitting equipment comprises a computer capable of executing the relevant hearing aid programming software and a programming device adapted to provide a link between the computer and the hearing aid.

Hearing loss of a hearing impaired person is quite often frequency-dependent and may not be the same for both ears. This means that the hearing loss of the person varies depending on the frequency. Therefore, when compensating for hearing losses, it can be advantageous to utilize frequency-dependent amplification. Hearing aids therefore often provide band split filters in order to split an input sound signal received by an input transducer of the hearing aid, into various frequency intervals, also called frequency bands, which are independently processed. In this way it is possible to adjust the input sound signal of each frequency band individually to account for the hearing loss in respective frequency bands. The frequency dependent adjustment is normally done by implementing a band split filter and a compressor for each of the frequency bands, hereby forming so-called band split compressors, which may be combined to form a multi-band compressor. In this way it is possible to adjust the gain individually in each frequency band depending on the hearing loss as well as the input level of the input sound signal in a respective frequency band. For example, a band split compressor may provide a higher gain for a soft sound than for a loud sound in each frequency band.

When fitting a hearing aid it has been suggested to read out all fitting related data from the hearing aid and to the fitting software, when the hearing aid is programmed. This data read out may take up to several tens of seconds, which is considered annoying by many hearing care professional. However, the fitting related data are read out in order to ensure that none of the hearing aid EEPROM memory banks have been corrupted and in order to know the exact status of the hearing aid.

U.S. Pat. No. 8,064,609 discloses a method where the fitting software for the specific type of hearing aid to be fitted next is pre-loaded based on e.g. the fitter's calendar or a detection of the specific hearing aid in the waiting room. Disclosed is also pre-loading of data related to the hearing of the next patient to be fitted.

U.S. Pat. No. 4,989,251 discloses a system where a first checksum is calculated for the data to be stored in the hearing aid, by a fitting computer external from the hearing aid, and subsequently calculating a second checksum for the stored data after having being transmitted back to the fitting computer and allowing the hearing aid to return to normal operation if the two checksums match.

WO-A1-9009760 discloses a system where checksums are used to detect errors resulting from transmission of data to the hearing aid and in response to such a detected error simply re-transmit the data. Thus the purpose is not related to minimizing the time for reading out data from the hearing aid.

U.S. Pat. No. 6,782,110 discloses a method for detecting and removing errors in the transmission and storage of data, wherein the digital hearing aid itself has means for internally checking received and stored data, whereby detection of data errors which arise within the hearing device during the course of storage and/or data transmission procedures is possible. Data errors which arise in the hearing aid subsequent to a correct data transmission (possibly from a host computer via an interface) can thus be detected. Furthermore substantially continuous data storage procedures (routines) and data transmission procedures (routines) occur during the operation of a digital/digitally programmable hearing device and errors which may occur arising during these routines may also be detected. In particular, data errors arising in the data transmission between a secondary memory and the main memory may be detected. In the operation of a digital hearing device new programs are continuously loaded from a secondary memory into the main memory or from the main memory into the processing unit, so that data errors also can arise in such transmissions with a relatively high probability.

EP-B1-2317780 discloses a hearing aid with redundant memory and a method of operating the hearing aid such that at least one of two memories always holds valid data.

It is a feature of the present invention to provide a method of fitting a hearing aid system that improves the speed of the hearing aid fitting.

It is another feature of the present invention to provide a hearing aid fitting system adapted to provide a hearing aid fitting that may be carried out in a shorter amount of time.

It is yet another feature of the present invention to provide a hearing aid system adapted to carry the method of fitting a hearing aid system according to the invention.

SUMMARY OF THE INVENTION

The invention, in a first aspect, provides a method of operating a hearing aid fitting system comprising the steps of: storing first data in a hearing aid memory; storing second data in an external memory, wherein the second data is a copy of the first data; using a hearing aid processor to generate a first hash key representing the first data, using a fitting device processor to generate a second hash key representing the second data; providing the first hash key to the fitting device; comparing the first hash key with the second hash key in order to determine whether the values of the first and the second hash key match; and triggering a specific action in response to the result of the comparison of the hash keys.

The invention, in a second aspect, provides a hearing aid system having at least one hearing aid comprising: an acoustical-electrical input transducer, a digital signal processor, an electrical-acoustical output transducer and a memory and wherein the digital signal processor is adapted to generate a first hash key representing at least some of the data stored in the memory and to provide the first hash key to an external fitting device.

The invention, in a third aspect, provides a hearing aid fitting system for carrying out the method described above.

Further advantageous features appear from the dependent claims.

Still other features of the present invention will become apparent to those skilled in the art from the following description wherein embodiments of the invention will be explained in greater detail.

BRIEF DESCRIPTION OF THE DRAWINGS

By way of example, there is shown and described a preferred embodiment of this invention. As will be realized, the invention is capable of other embodiments, and its several details are capable of modification in various, obvious aspects, all without departing from the invention. Accordingly, the drawings and descriptions will be regarded as illustrative in nature and not as restrictive. In the drawings.

DETAILED DESCRIPTION

In the following the terms hearing aid fitter and hearing care professional may be used interchangeably. The same is true for the terms "programming" (a hearing aid), "storing" (data in a hearing aid) and "fitting" (a hearing aid).

Furthermore the term "hash key" is to be construed to mean the value of the hash key and the terms "hash key" and "hash key value" may therefore be used interchangeably.

Figure 1:
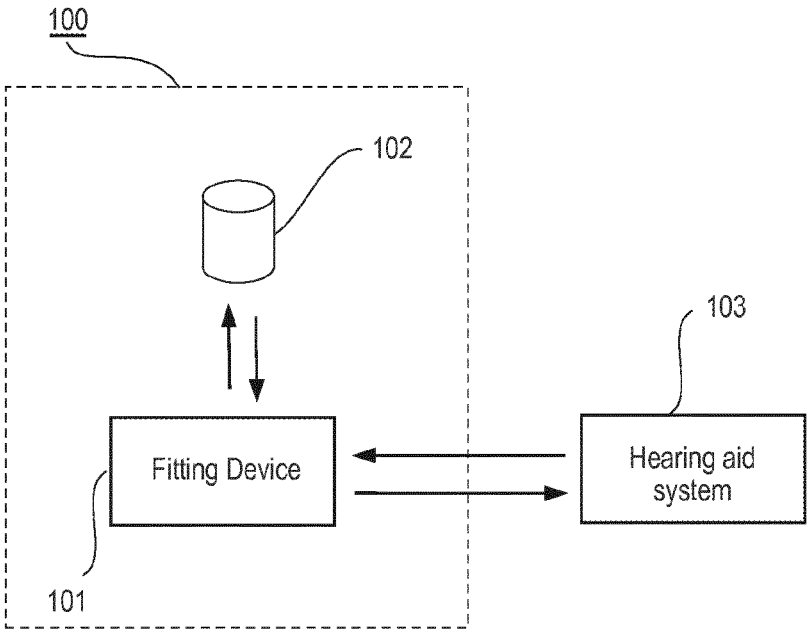
FIG. 1 illustrates highly schematically a hearing aid fitting system according to an embodiment of the invention.

Reference is first made to FIG. 1, which highly schematically illustrates a hearing aid fitting system 100 according to an embodiment of the invention.

The hearing aid fitting system 100 comprises a fitting device 101 and an external memory 102. Also illustrated in FIG. 1 is a hearing aid system 103 to be fitted by the fitting system.

FIG. 1 illustrates that the fitting device 101 is adapted to transmit and store (i.e. program) data in the hearing aid system 103 and also to extract data from the hearing aid system 103. Furthermore the fitting device 101 is adapted to transmit and store data in the external memory 102 and also to extract data from the external memory 102.

In variations the fitting device 101 may be a personal computer, a tablet, a smart phone or a smart watch.

In variations the external memory 102, may be integrated as part of the fitting device or the external memory may be part of a remote server.

Figure 2:
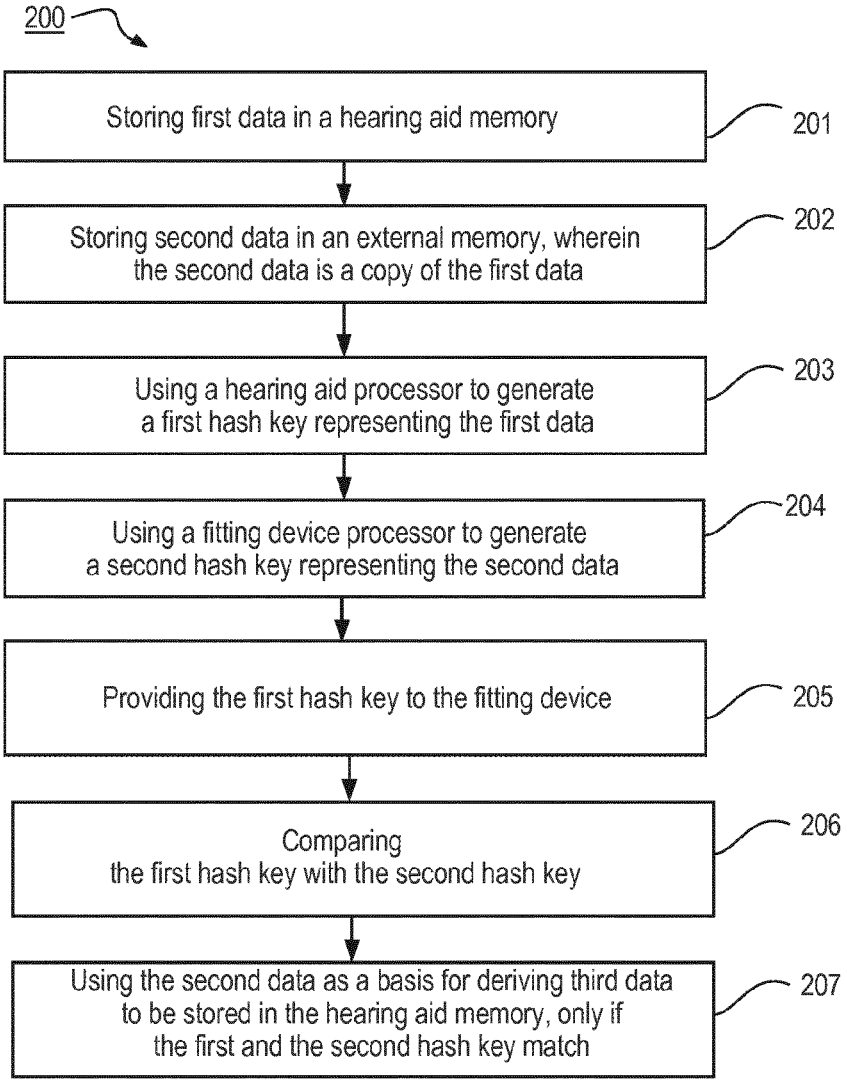
FIG. 2 illustrates highly schematically a method of fitting a hearing aid system according to an embodiment of the invention.

Reference is now made to FIG. 2, which illustrates highly schematically a method 200 of fitting a hearing aid system according to an embodiment of the invention.

In the following reference will be made to a hearing aid, despite the fact that a hearing aid system may also comprise two hearing aids, wherefrom it follows that in case a binaural hearing aid system is considered then the two hearing aids will be fitted at least partly sequentially.

In a first step 201 first data are stored in a hearing aid memory. The first data may basically represent any type of data that needs be stored in a hearing aid in order for the hearing aid to function properly. Therefore this type of data may e.g. be used to provide in the hearing aid at least one of hearing loss compensation, noise reduction, speech enhancement and sound environment classification.

In a second step 202 second data are stored in an external memory (relative to the hearing aid), wherein the second data is a copy of the first data.

In the present context the term "copy" is to be construed in a broad manner, wherein it simply means that two copies of the same data is stored in two different memories.

Depending on the specific use case the external memory may be located within the premises of a specific hearing care professional or may be located on a remote server, whereby potentially anyone with the proper rights can access the data stored on the remote server. The memory may also be integrated in a smart phone, tablet or any other internet enabled personal communication device.

In a third step 203 a hearing aid processor is used to generate a first hash key representing the first data.

Depending on the specific use case the first hash key is generated in response to a request from a fitting device, but alternatively the first hash key may also be generated automatically, e.g. immediately after the first data are stored in the hearing aid memory.

In the present context the term "hash key" is to be construed in a broad manner, in order to cover the general concept of an arbitrary number that is created from a given amount of data such that the value of a current hash key may be used to determine whether the given amount of data has been corrupted or changed, since the previous calculation of the value of the hash key.

In the present context the term "check sum" is to be construed as being distinguishable from the term "hash key" in so far that a "check sum" is better suited for efficient processing and fast detection of common errors, while being more prone to collisions (i.e. the effect that two different sets of data can generate the same check sum or hash key). However, the functionality provided by respectively a hash key and a check sum is basically the same, and therefore it will in variations be possible to replace one with the other although this will generally lead to less efficient methods and systems.

It is further noted that a cyclic redundancy check (CRC), check digits and parity bits are generally considered to be special cases of check sums.

In a fourth step 204 a fitting device processor is used to generate a second hash key representing the second data. According to an embodiment the second hash key is not generated until a so called re-fitting is carried out, which may take place days, weeks or months after the initial fitting, wherein the first and second data are stored. It is a specific advantage that the second hash key needs not be stored together with the second data, because it may be cumbersome to store meta data such as the second hash key together with the data stored in the hearing aid.

Depending on the specific use case the fitting device may be selected from a group comprising a personal computer, and an internet enabled personal communication device such as a smart phone or a tablet.

In a fifth step 205 the first hash key is provided to the fitting device. In most use cases the first hash key will be provided to the fitting device in response to a request received from the fitting device, but in variations this may be carried out automatically e.g. with regular intervals.

In a sixth step 206 the first hash key is compared with the second hash key. In most use cases the comparison will be carried out by the fitting device, but in variations the comparison may be carried out by e.g. a remote server and only the result of the comparison is provided to the fitting device. However, the latter variation is generally not a preferred option.

In a seventh and final step 207 the second data is used as basis for deriving third data to be stored in the hearing aid memory, only if the first and the second hash keys match. Hereby the duration of the hearing programming may be shortened because it is not required to transmit large amounts of data from the hearing aid system and to the fitting device in order to ensure that the data stored in the hearing aid are valid.

In case the hash keys don't match the first data must be read out from the hearing device and provided to the fitting device, where it is used to derive the third data.

In the following the method of FIG. 2 may be denoted a re-fitting of the hearing aid system. The re-fitting comprises the steps that are required for deriving the third data to be stored in the hearing aid system.

It is noted that contemporary hearing aids typically store data required for the proper functioning in memories of the EEPROM type and this type is known to be susceptible to data errors as a result of e.g. insufficient hearing aid battery voltage when reading or writing data to an EEPROM memory. However, in variations the data may be stored in any type of non-volatile memory including e.g. flash memory.

Figure 3:
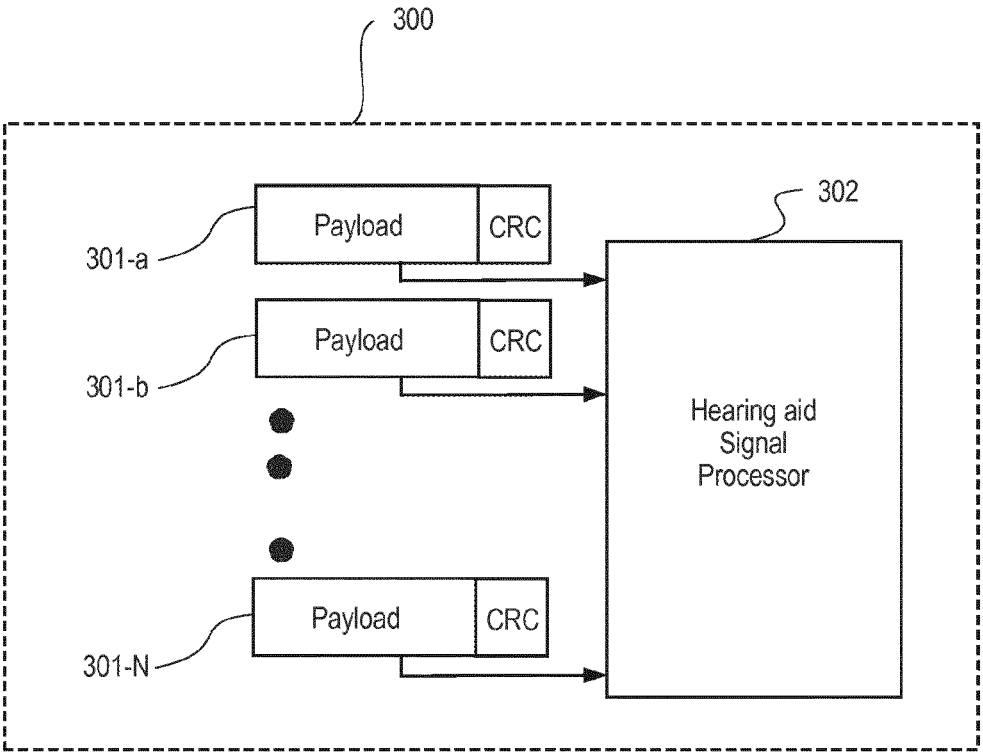
FIG. 3 illustrates highly schematically selected parts of a hearing aid according to an embodiment of the invention.

Reference is now made to FIG. 3, which illustrates highly schematically selected parts 300 of a hearing aid according to an embodiment of the invention.

The selected parts 300 comprises a multitude of so called EEPROM memory banks 301*a*, 301-*b*, . . . 301-N, a hearing aid signal processor 302. The features provided by the hearing aid signal processor 302 are controlled at least partly by the data from the EEPROM memory banks 301*a*, 301-*b*, . . . 301-N. To obtain this the hearing aid signal processor needs to read at least some of the data from the EEPROM memory banks 301*a*, 301-*b*, . . . 301-N as illustrated by the arrows from the memory banks 301*a*, 301-*b*, . . . 301-N and to the hearing aid signal processor 302. According to the present embodiment the value of a hash key representing the data read from the EEPROM memory banks 301*a*, 301-*b*, . . . 301-N is generated by the hearing aid signal processor 302 and transmitted to a fitting device requesting the generation of the hash key. Preferably the hash key is generated based on all the data in the EEPROM memory banks 301*a*, 301-*b*, . . . 301-N, but in variations of the present embodiments data that will typically change during normal operation, such as logged data and hearing aid settings learned in response to a hearing aid user interacting with the hearing aid system, will be omitted from the data that the hash key represent and the same is true for data that are considered less important, such as stored speech messages.

In another variation the hash key is generated based on a multitude of check sums, e.g. of the cyclic redundancy check (CRC) type, instead of being generated directly from the payload data of the EEPROM memory banks 301*a*, 301-*b*, . . . 301-N, whereby the complexity and time required to generate the hash key may be reduced because the amount of data used to represent the check sums are significantly smaller than the data the check sums are generated from. Furthermore this variation is advantageous because it need not be necessary to generate the multitude of check sums because they are already stored in the hearing aid. This may be the case because it is already known in some contemporary hearing aids to calculate a check sum value, such as a CRC, when the payload data, from the EEPROM memory banks, is read and subsequently transferred to a working memory during normal operation of the hearing aid. The calculated check sum value is compared with the check sum value already stored in the corresponding EEPROM memory bank and if the two values are not identical then the hearing aid is muted, in order to avoid damaging peoples hearing due to faulty data. Therefore the additional processing required to base the hash key on the check sums may be limited because the check sums are already calculated and stored.

According to a first use case, which represents what is common practice in most contemporary hearing aid clinics a fitting device in the form of e.g. a personal computer (PC) is operationally connected to the hearing aid system and additionally the PC has access to a memory external form the hearing aid. Thus this may be a memory located in the hearing aid clinic or a memory located on some remote server.

The first time a hearing aid is programmed by a hearing care professional, the data to be stored in the hearing aid is normally derived based on an audiogram of the hearing aid user and possibly some other tests directed at finding the best hearing setting with respect both to speech intelligibility and the personal preferences of the hearing aid user. This is carried out using hearing aid fitting software installed on the fitting device. When the data has been derived the next step is to store the data in the EEPROM memory banks of the hearing aid and subsequently read out the data, generate a first hash key and transmit it back to the fitting device where the first hash key is compared with a second hash generated by the hearing aid fitting software on the fitting device and if the values of the two hash keys match, then it may be concluded that the storage of data in the hearing aid has been successful and may be terminated.

When the hearing care professional receives new hearing aids from the manufacturer then some user independent data will already be stored in the hearing aid and it may be advantageous to check the validity of these data, which may be done by comparing stored and recently generated check sums representing the same stored data and providing the result of the comparisons to the fitting device. Generally the hash key aspect of the invention is discarded for this variation because the pre-stored (user independent) data from the hearing aid manufacturer is not available for the fitting device, but, on the other hand, it may, in a further variation, be possible to make the user independent data available, e.g. on a remote server.

According to yet another variation both the first hash key and the results of the validity checks carried out by comparing stored and newly generated check sums in the hearing aid are provided to the fitting device whereby even more detailed information of the data stored in the hearing aid is provided to the fitting device, in so far that the check sum comparisons can point out which parts of the first data have been corrupted.

Under all circumstances it should be appreciated that the methods and systems according to the invention may be applied advantageously for different parts of the hearing aid system fitting process.

It is often advantageous for a hearing aid user to visit a hearing aid clinic for a so called follow up visit, which may also be denoted a re-fitting, and in this case the fitting device will request the hearing aid to provide the first hash key that represents the first data stored in the hearing aid and also request to provide the second hash key based on the second data stored in the external memory. Thus either the second hash key is stored in the external memory or the fitting device may have the second hash key generated based on the second data stored in the external memory. The fitting device then compares the first and second hash keys and if they match the fitting device can use the easily accessible second data from the external memory as a basis to derive new and optimized third data for the hearing aid.

When storing the new and optimized third data for the hearing aid it may be chosen to generate a new first hash key in the hearing aid and provide it to the fitting device in order to ensure that the upload to and storage of the third data in the hearing aid was successful, but this needs not be done and neither is it a pre-requisite for carrying out the invention in the context of a follow-up visit that the initial fitting is carried out in a specific manner.

Another use case it related to fine tuning that the hearing aid user prefers to carry out without the aid of a hearing care professional. This use case corresponds closely to the follow-up visit scenario except for the fact that the fitting device will typically be a personal communication device such as a smart phone and that the external memory will typically be accommodated in a remote server that the can be accessed using the internet enabled personal communication device. According to an embodiment the internet enabled personal communication device needs to download a software application in order to be able to carry out the fine tuning and in a variation the fine tuning is carried out by using a web service that is hosted on an external server and accessed using a web browser. Typically the hearing aid user will communicate with the personal communication device through a graphical user interface that is controlled by the software application or the web service.

In yet another use case the follow-up visit is carried out by a hearing care professional as a remote fitting. Thus this use case corresponds to the initially described follow-up visit except in that either the hearing aid system needs to directly connected to the internet or connected via a gateway that will typically be a personal communication device of the hearing aid user. Such systems are well known within the art of hearing aid systems.

In an embodiment, the first data represented by the first hash key does not include data that is stored in the hearing aid in response to interactive learning of user preferences, because these data may be stored in between two subsequent hearing aid fitting events (i.e. during normal operation of the hearing aid system) and consequently the first and second hash keys will not match if these types of stored data are represented by the hash keys.

However, in a variation the interactive learning may be carried out using an internet enabled personal communication device whereby both the hearing aid and the personal communication device will be able to derive the learned data to be stored in the hearing aid and consequently the first and second hash keys can be generated based on the same data.

In yet another variation the hearing aid system is adapted to provide to the fitting device current first data each time a change in the stored first data has occurred. Hereby the fitting device can generate a new second hash key that represents the current stored first data in the hearing aid each time e.g. an interactive learning scheme changes the first data stored in the hearing aid. This option is advantageous in case the interactive personalization is not carried out using a fitting device, which will be the case if e.g. hearing aid includes a volume control and the hearing aid is set-up to learn the hearing aid user's preferred volume setting in e.g. a given sound environment.

According to still another embodiment the hearing aid system may be set up to provide the first hash key to a fitting device in response to a user requesting assistance due to an unsatisfactory hearing aid performance, which may result e.g. due to muting of the hearing aid because of an unintended change of the data in the EEPROM memory banks during normal operation, typically due to a low supply voltage while reading from or writing to the EEPROM memory banks. By providing the first hash key to the fitting device the first and second hash keys may be compared and if they do not match there is a good chance that the hearing aid performance can be restored simply by uploading the second data to the hearing aid.

In variations, the present invention may be implemented in any audio device comprising an acoustical-electrical input transducer and an acoustical-electrical output transducer adapted to provide a perception of audio in a human being. Headsets, personal sound amplifiers and hearables are examples of such audio devices.

According to another variation, the hearing aid system needs not comprise a traditional loudspeaker as output transducer. Examples of hearing aid systems that do not comprise a traditional loudspeaker are cochlear implants, implantable middle ear hearing devices (IMEHD), bone-anchored hearing aids (BAHA) and various other electro-mechanical transducer based solutions including e.g. systems based on using a laser diode for directly inducing vibration of the eardrum.

The invention claimed is:

1. A method of fitting a hearing aid system comprising the steps of:

storing first data in a hearing aid memory;

storing second data in an external memory, wherein the second data is a copy of the first data;

using a hearing aid processor to generate a first hash key representing the first data, using a fitting device processor to generate a second hash key representing the second data;

providing the first hash key to the fitting device;

comparing the first hash key with the second hash key in order to determine whether the values of the first and the second hash key match; and triggering a specific action in response to the result of the comparison of the hash keys; and wherein the step of triggering a specific action comprises:

using the second data as a basis for deriving third data to be stored in the hearing aid memory, if the values of the first and the second hash key match, and providing the first data from the hearing aid and to the fitting device and using the first data as a basis for deriving third data to be stored in the hearing aid memory, if the values of the first and the second hash key don't match.

2. The method according to claim 1, comprising the further step of:

using the hearing aid processor to generate and store a multitude of first check sums that together represent the first data, when the first data are stored in the hearing aid memory.

3. The method according to claim 2, wherein the step of using a hearing aid processor to generate a first hash key representing the first data comprises the further step of:

using said multitude of first check sums that together represent the first data as basis for generating the first hash key.

4. The method according to claim 2, comprising the steps of:

using the hearing aid processor to generate a multitude of second check sums that together represent the first data in response to receiving a request from the fitting device, using the hearing aid processor to compare the multitude of first and second check sums and providing the results to the fitting device.

5. The method according to claim 4, wherein the step of triggering a specific action in response to the result of the comparison of the hash keys comprises the further step of:

using the fitting device to display the results of the comparisons of the multitude of first and second check sums, if the values of the first and the second hash key don't match.

6. The method according to claim 4, wherein the step of triggering a specific action in response to the result of the comparison of the hash keys comprises the further step of:

using the fitting device to display the results of the comparisons of the multitude of first and second check sums, independent on whether the values of the first and the second hash keys match, whereby the validity of user independent data that is pre-stored in a hearing aid by the hearing aid manufacturer may be checked.

7. The method according to claim 1 wherein the first data only represents a part of the data required to be stored in the hearing aid memory in order to make it operational, and wherein the selection of the first data is carried out using the fitting device.

8. The method according to claim 1, wherein the hearing aid memory is a nonvolatile memory.

9. The method according to claim 1, wherein the first data comprises data controlling at least one of hearing loss compensation, noise reduction, speech enhancement and sound environment classification in the hearing aid system.

10. The method according to claim 1, wherein the first data does not include data learned as a result of user interactions with the hearing aid system during normal operation of the hearing aid system.

11. The method according to claim 1, wherein the fitting device is selected from a group comprising a personal computer, tablet or smart phone.

12. A hearing aid fitting system adapted to carry out the method of claim 1.

* * * * *